US005604523A

United States Patent [19]

Tsukuda et al.

[11] Patent Number: 5,604,523

[45] Date of Patent: Feb. 18, 1997

[54] INK CONTAINER, AN INK JET CARTRIDGE AND INK JET RECORDING APPARATUS

[75] Inventors: Keiichiro Tsukuda, Kawasaki; Masanori Takenouchi, Yokohama, both of Japan

[73] Assignee: Canon Kabushiki Kaisha, Tokyo, Japan

[21] Appl. No.: 316,450

[22] Filed: Oct. 3, 1994

[30] Foreign Application Priority Data

Oct. 4, 1993 [JP] Japan ..... 5-247938

[51] Int. Cl.[6] ..... B41J 2/175; B41J 2/19

[52] U.S. Cl. ..... 347/86; 347/92

[58] Field of Search ..... 347/86, 92, 93

[56] References Cited

U.S. PATENT DOCUMENTS

| | | | |
|---|---|---|---|
| 4,368,478 | 1/1983 | Koto | 347/86 |
| 5,119,115 | 6/1992 | Buat et al. | 347/86 |

FOREIGN PATENT DOCUMENTS

| | | | |
|---|---|---|---|
| 0585615 | 3/1994 | European Pat. Off. . | |
| 9203206 | 7/1992 | Germany . | |
| 63-003958 | 1/1988 | Japan . | |
| 022653 | 1/1988 | Japan . | |
| 63-118260 | 5/1988 | Japan . | |
| 276554 | 11/1988 | Japan | 347/86 |
| 2039945 | 2/1990 | Japan . | |
| 96745 | 1/1993 | Japan | 347/86 |
| 104735 | 4/1993 | Japan | 347/86 |
| 162328 | 6/1993 | Japan | 347/86 |

OTHER PUBLICATIONS

IBM Technical Disclosure Bulletin, vol. 34, No. 1, Jun. 1991, "Replaceable Ink Cartridge for Ink Jet Print Head".

*Primary Examiner*—N. Le

*Attorney, Agent, or Firm*—Fitzpatrick, Cella, Harper & Scinto

[57] ABSTRACT

An air communicating hole and an opening circular in cross section are formed in the wall portions of the housing of the ink container. On the inner wall portion surrounding the opening is formed an ink inductive portion which is shaped in the form of an almost solid circular cylinder. The projected end of the ink inductive portion is provided with a cartridge filter as a first filter that forms a boundary with the porous material that works as an ink holding means. The ink inductive portion is virtually solid as a whole and has at least one fine hole formed in the solid portion in such a way that it extends longitudinally to communicate the opening to the interior of the housing where the porous material is installed. At the end of the solid portion of the ink inductive portion is formed a recess as a bubble removing means that removes air bubbles from ink being supplied to the ink jet recording head by retaining the bubbles in the recess.

16 Claims, 8 Drawing Sheets

INK CONTAINER, AN INK JET CARTRIDGE AND INK JET RECORDING APPARATUS

BACKGROUND OF THE INVENTION

1. Field of the Invention

The present invention relates to an ink container having an improved connection with a recording head, to an ink jet cartridge having such an ink container, and to an ink jet recording apparatus capable of mounting such a cartridge. More particularly, the present invention relates to an ink container having a recording head connecting portion capable of preventing ink from leaking out, an ink jet cartridge having such an ink container, and an ink jet recording apparatus that can mount such a cartridge.

2. Description of the Prior Art

Japanese Laid Open Patent Application No. 118260/1988 proposes an ink jet cartridge that consists of an ink jet recording head that ejects ink droplets hereinafter referred to simply as a recording head) and an ink container that supplies ink to the recording head, both components being integrally formed in one piece. The ink container for such an ink jet cartridge generally has installed compressed therein a porous material absorbed with ink. An ink supply port of the ink container is connected to an ink inducing port of the recording head. The ink absorbed in the porous material held in the ink container is led through a common liquid chamber of the recording head to a plurality of ink ejection nozzles, from which the ink is ejected. The ink contained in the ink container is led to the recording head by capillary action according to the amount of ink used by the recording head.

In such an ink jet cartridge, however, because an energy generating section incorporated in the recording head that produces energy for discharging ink droplets is formed integral with the ink container that supplies ink to the recording head, when ink in the ink container is run out, the recording head that is still usable has to be replaced along with the empty container. To use the recording head for as long a period as possible necessitates increasing the capacity of the ink container. These is the factor standing in the way for reducing the overall size of the ink jet cartridge.

As a means to solve this problem, Japanese Laid Open Patent Application No. 3958/1988 proposes a construction, in which the recording head and the ink container can be connected to and disconnected from each other on a carriage of the ink jet recording apparatus (hereinafter referred to simply as a recording apparatus). This on-carriage head-container separation type allows the full use of the recording head to the end of its life by repeatedly exchanging only the ink container, making it possible for a single recording head to print a large number of characters.

As such a separation type of the ink container, there is a known container having an open-close valve mechanism which is capable to close a connecting opening in order to prevent ink from outflow toward the outside of the container, the outflow being occurred from the inside thereof through a connecting portion.

With this conventional construction, when the ink container, after having been coupled to the recording head on the carriage, is disconnected again from the recording head in order to perform the exchange of ink container on the basis of the data which informs empty of the container, the outflow of ink from the inside of the ink container is controlled by the valve mechanism. However, there is a problem that some ink, in whatever amount, remains in the vicinity of the outer peripheral part of the connecting portion of the ink container, the connecting portion being connected with the recording head. If the amount of the ink remained in the connecting portion is large, the ink may spill from the connecting portion of the ink container into the recording apparatus. After the ink container is removed from the carriage, ink may be leaked out from the ink container to fall fouling the surrounding of the recording apparatus.

SUMMARY OF THE INVENTION

A first object of the present invention is to provide an ink container that can reliably prevent ink from dripping.

A second object of the present invention is to provide an ink jet cartridge including the ink container.

A third object of the present invention is to provide an ink jet recording apparatus in which the ink jet cartridge can be mounted.

To achieve the first object, an ink container is provided, the ink container having: a housing accommodating a means to hold ink; and an ink supply means provided in a part of the housing to supply ink held in the ink holding means to an ink jet recording head, wherein the ink supply means includes an opening penetrating through a wall portion of the housing and an ink inductive portion provided between the opening and the ink holding means, the ink inductive portion including a solid portion projecting from the wall portion of the housing near the opening toward the ink holding means, and at least one fine hole provided in the solid portion to communicate the opening with the interior of the housing.

Here, the solid portion of the ink inductive portion may be formed as a solid circular cylinder and the fine hole may be a plurality of fine holes formed parallel to the axis of the solid portion and arranged at equal intervals along a circumferential surface of a cylinder which is concentric with and smaller in diameter than the cylindrical solid portion.

The solid portion of the ink inductive portion may be formed as a solid circular cylinder and the fine hole may be formed at the axis of the solid portion.

An inner surface of the opening and a part of an inner surface of the fine hole in the ink inductive portion may be continuous with each other.

It may further comprise a connecting surface that makes continuous the inner surface of the opening and a part of the inner surface of the fine hole in the ink inductive portion.

The ink holding means may be a porous material and an end of the solid portion of the ink inductive portion presses against a part of the ink holding means.

The wall portion of the housing where the opening of the ink supply means may be formed faces a wall portion of the housing where an air communicating hole is formed.

It may further comprise a bubble removing means which includes a clearance defined between the end of the solid portion of the ink supply means and the ink holding means and which removes air bubbles from ink being supplied to the ink jet recording head by collecting and keeping the bubbles in the clearance.

The bubble removing means may be a recess formed in the end of the solid portion of the ink supply means.

The bubble removing means may cooperate with the fine hole formed at the axis of the solid portion of the ink supply means to discharge the bubbles removed from the ink and temporarily retained in the recess toward the opening side.

It may further comprise a first filter arranged at the end of the solid portion of the ink supply means to filter ink from the ink holding means.

To achieve the second object, an ink jet cartridge is provided, the ink jet cartridge having an ink container and an ink jet recording head, wherein the ink container includes a housing having a means to hold ink; an ink supply means provided in a part of the housing to supply ink held in the ink holding means to an ink jet recording head; and an engagement portion provided near the ink supply means to achieve coupling and decoupling between the housing and the ink jet recording head; wherein the ink supply means includes an opening penetrating through a wall portion of the housing and an ink inductive portion provided between the opening and the ink holding means; and the ink inductive portion includes a solid portion that projects from the wall portion of the housing near the opening toward the ink holding means, and at least one fine hole provided in the solid portion to communicate the opening with the interior of the housing; and wherein the ink jet recording head includes an engagement portion that engages with the engagement portion of the ink container; a pipe to be inserted into the opening of the ink supply means of the ink container when the engagement portions of the ink container and the recording head are engaged; an ink ejection port to eject ink supplied from the ink container through the pipe; and an ink ejection energy generating element to impart an energy to the ink ejected from the ink ejection port.

Here, it may further comprise a second filter arranged between the pipe and the ink ejection port.

The ink ejection energy generating element may be an electricity-heat converter that generates thermal energy to cause a surface boiling to the ink.

To achieve the third object, an ink jet recording apparatus is provided, the apparatus comprising: an ink jet cartridge including an ink container and an ink jet recording head; and a means to removably mount the ink jet cartridge to the ink jet recording apparatus; wherein the ink container includes: a housing having a means to hold ink; an ink supply means provided in a part of the housing to supply ink held in the ink holding means to an ink jet recording head; and an engagement portion provided near the ink supply means to achieve coupling and decoupling between the housing and the ink jet recording head; wherein the ink supply means includes an opening penetrating through a wall portion of the housing and an ink inductive portion provided between the opening and the ink holding means; and the ink inductive portion includes a solid portion that projects from the wall portion of the housing nearer the opening toward the ink holding means, and at least one fine hole provided in the solid portion to communicate the opening with the interior of the housing; and wherein the ink jet recording head includes: an engagement portion that engages with the engagement portion of the ink container; a pipe to be inserted into the opening of the ink supply means of the ink container when the engagement portions of the ink container and the recording head are engaged; an ink ejection port to eject ink supplied from the ink container through the pipe; and an ink ejection energy generating element to impart an energy to the ink ejected from the ink ejection port.

Here, the ink ejection energy generating element may be an electricity-heat converter that generates thermal energy to cause a surface boiling to the ink.

The above and other objects, effects, features and advantages of the present invention will become more apparent from the following description of embodiments thereof taken in conjunction with the accompanying drawings.

DETAILED DESCRIPTION OF EMBODIMENTS

Embodiments of the present invention will be described in detail by referring to the accompanying drawings.

(Embodiment 1)

Figure 1A:
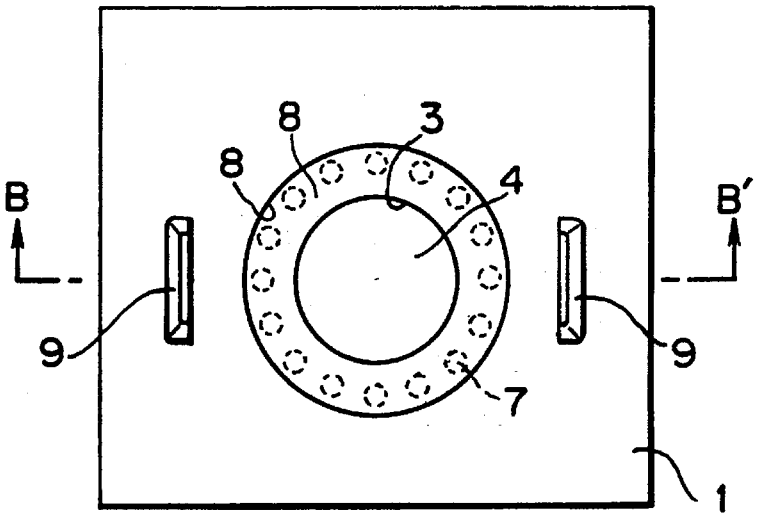
FIG. 1A is a front view of a first embodiment of an ink container according to the present invention.
Figures 1B, 1C:
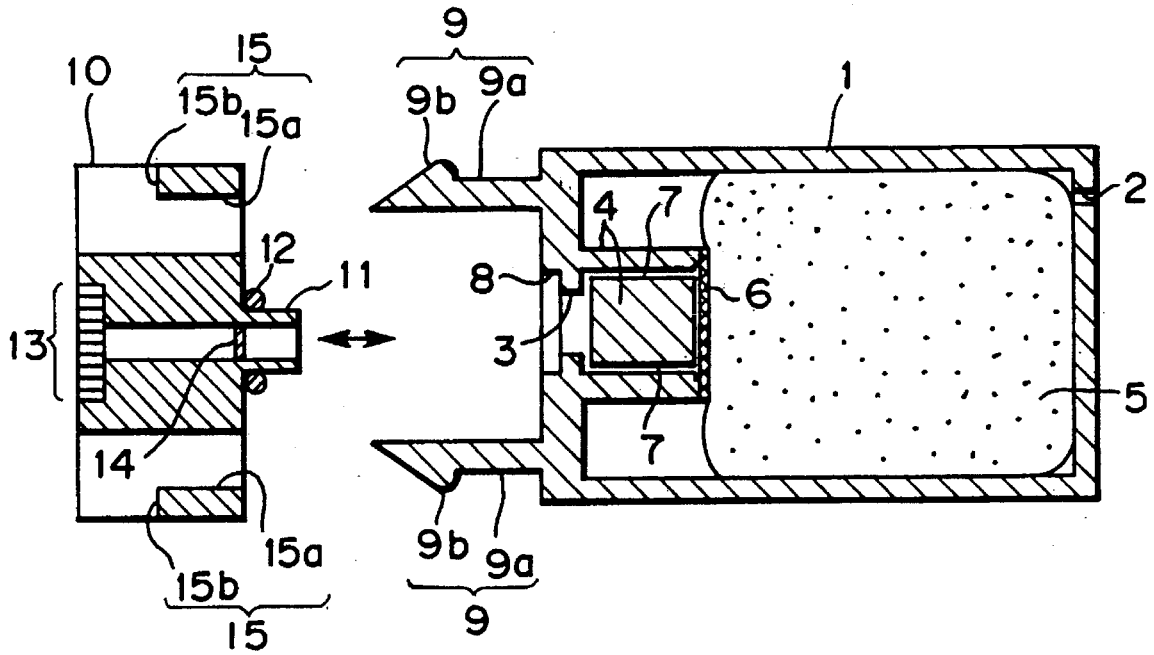
FIG. 1B is a cross section taken along the line B-B' of FIG. 1A.
FIG. 1C is a cross section of an ink jet recording head to which the ink container shown in FIG. 1A and 1B can be coupled.

FIGS. 1A and 1B show an ink container as a first embodiment of the present invention. FIG. 1A is a schematic front view, and FIG. 1B is a schematic cross section taken along the line B-B' of FIG. 1A. FIG. 1C is a schematic cross section showing the construction of a recording head that can be removably coupled to the ink container of FIGS. 1A and 1B.

Referring to FIG. 1, reference numeral 1 represents a hexahedral housing or enclosure of the ink container. The housing 1 has an ink chamber therein whose one wall is formed with a hole 2 that communicates the interior with ambience and another wall is formed with an opening 3 circular in cross section that forms a part of a liquid passage for supplying ink to an ink jet recording head described later. At an area of the inner wall of the housing 1 that surrounds the opening 3, a cylindrical ink inducing section protrudes inwardly perpendicular to the wall surface. The ink ducing section consists of a solid portion 4, which is almost solid as a whole, and a plurality of fine holes 7 that connect the opening 3 to the interior of the housing 1. At one end of the solid portion 4 is provided a cartridge filter 6 as a first filter, which filters ink absorbed in a porous material 5 that, as an ink holding means, is installed contracted in the housing 1. The porous material 5 may suitably use a sponge.

The fine holes 7 in the ink inducing section extend along the length of the solid portion 4 (in the left-right direction in FIG. 1B). As shown in FIG. 1B, the fine holes 7 are arranged at equal intervals along a circumference of an imaginary cylinder having the axis of the solid portion 4 as its center so that they extend along the axis of the solid portion 4. Ink supply through the solid portion 4 of the ink inducing section excluding the fine holes 7 is of course not possible. In this embodiment, the opening 3, the solid portion 4 and the fine holes 7 together form an ink supply means. Here, when this ink container is applied to the ink jet recording apparatus by amounting it to the recording head described later, it is necessary to make the inner volume of each fine hole 7 in the ink container extremely small, preferably less than 0.05 cc, in order to feed ink to the head side by means of an ink ejection performance recovering mechanism of the recording apparatus. Although the size of the fine holes 7 may vary depending on their number, they are preferably 0.5 mm to 1.5 mm in diameter.

In this embodiment, because the radius of the imaginary cylinder along which the fine holes are arranged is set larger than the radius of the opening 3, the fine holes 7 are shown by the dot line in FIG. 1A. It is preferred that the inner circumferential surface of the opening 3 and a part of the inner circumferential surface of the fine holes 7 form a continuous surface. This is to allow the ink adhering to the inner circumferential surface of the opening 3 to easily move along such a continuous surface and return into the housing 1 through the fine holes 7.

The fine holes 7 in the ink inducing section are about 0.5–1.5 mm across, which falls within a range where capillary attraction can work. The porous material 5 in the ink container has a stronger capillary attraction than the fine holes 7 so that when ink is present in the fine holes 7 and the ink container, the ink in the fine holes 7 are readily drawn back into the porous material 5.

The ink present at and around the opening 3 can also be drawn back into the porous material 5 easily as it is contiguous to the ink that exists in the fine holes 7. The inner surface spanning from the opening 3 to the fine holes 7 in particular is formed as a continuous surface, so that ink is not easily interrupted or divided, improving the reliability in recovering ink from around the opening 3. Because the ink at and around the opening 3 is easily drawn to the porous material, it is possible to prevent dripping of ink and therefore smearing of apparatus and surroundings at time of ink container replacement.

Where the ink container is coupled with the recording head, the balance with meniscus at the ink ejection nozzles of the recording head ensures proper supply of ink to the recording head.

The outer wall of the housing 1 is formed with a circular recess 8 enclosing the opening 3. In the recess 8 is installed an 0-ring 12 that fixes an insertion pipe 11 of the recording head described later as it is inserted into the opening 3.

The outer wall of the housing 1 is further formed with a pair of arrow-headed engagement projections 9 that protrude perpendicularly from the wall surface that serves as a contact surface when the ink container and the recording head are joined. The engagement projections 9 each consist of a shank portion **9*a* and a bulged portion 9*b* formed at the end of the shank portion 9*a*. The bulged portion 9*b*, as shown in FIG. 1B, has an enough height from the shank portion 9*a* and also has a moderately curved surface extending up to its vertex. At least a portion of the engagement projection 9** that is deformed at time of engagement is preferably made from a material that, after deformation, will readily recover its original shape.

In an ink jet recording apparatus to which the ink container of the above construction is applied, it is necessary to keep negative the ink pressure that acts on the ink ejection nozzles of the recording head in order to stabilize the recording performance. In this case, the ink pressure in the ink container is held negative by the capillary attraction of the porous material 5. Because the ink container of the present invention is of a type that can be coupled to and decoupled from the recording head, there are times when the ink container alone is handled independently. In that case, ink may spill inadvertently from the opening 3. To prevent this, a valve mechanism or other mechanism that can prevent ink leakage may be provided in the opening 3 or the ink inducing section.

The ink container described above can be mounted to an ink jet recording head having a construction of FIG. 1C, for example.

FIG. 1C is a schematic cross section showing one embodiment of the recording head according to the present invention. In FIG. 1C, numerical 10 is a housing of the recording head. The housing 10 has an insertion pipe 11 protruding perpendicularly from the wall surface thereof. The insertion pipe 11 is inserted into the opening 3 of the ink container to provide a liquid path for the supply of ink from the ink container. At the base of the insertion pipe 11 the above-mentioned 0-ring 12 is fixedly installed on the wall surface of the housing 10. The insertion pipe 11 communicates through the interior of the housing 10 to the ink ejection nozzles 13 to allow ink to be supplied from the ink container to the nozzles. Inside the insertion pipe 11 is provided a cleaning filter 14 as a second filter that removes foreign matters from ink before the ink is ejected. The effective porous diameter of the cleaning filter 14 is in the range of 5–20 micron. In the wall of the housing 10 where the insertion pipe 11 is formed, engagement holes 15 are formed at positions corresponding to the engagement projections 9 of the ink container to receive and engage the engagement projections 9. The engagement holes 15 each consist of a guide portion **15*a* that guides the engagement projection 9 and a hook portion 15*b* that locks the bulged portion 9*b* of the engagement projection 9 and which is formed at a position deeper than the guide portion 15*a*. These engaging portions, once locked, cannot be disengaged by a pull less than a specified force. But when a pull greater than the specified force is applied, the bulged portion 9*b* of the engagement projection 9 rides over the hook portion 15*b* and returns to the guide portion 15*a***, thus unlocking the engaged portions. In this case, an engagement locking mechanism or an engagement unlocking mechanism may be provided.

(Embodiment 2)

Figure 2A:
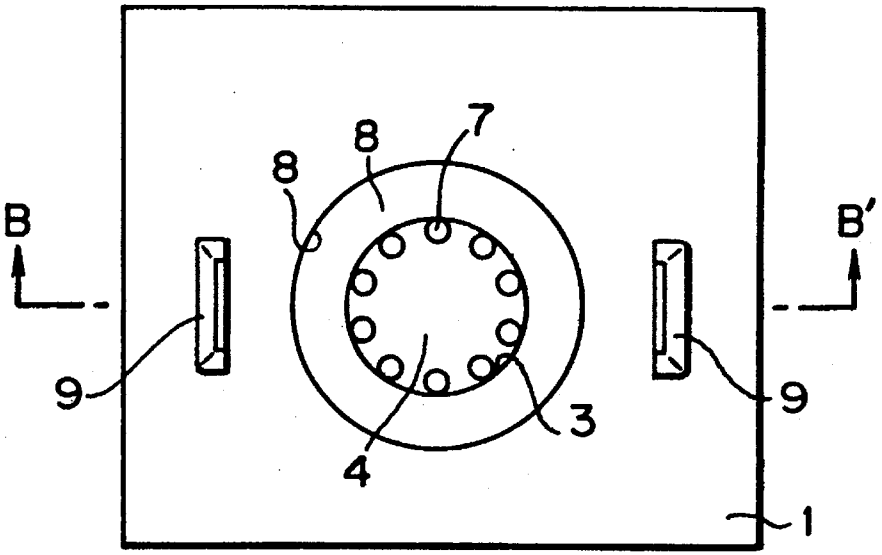
FIG. 2A is a front view of a second embodiment of an ink container according to the present invention.
Figure 2B:
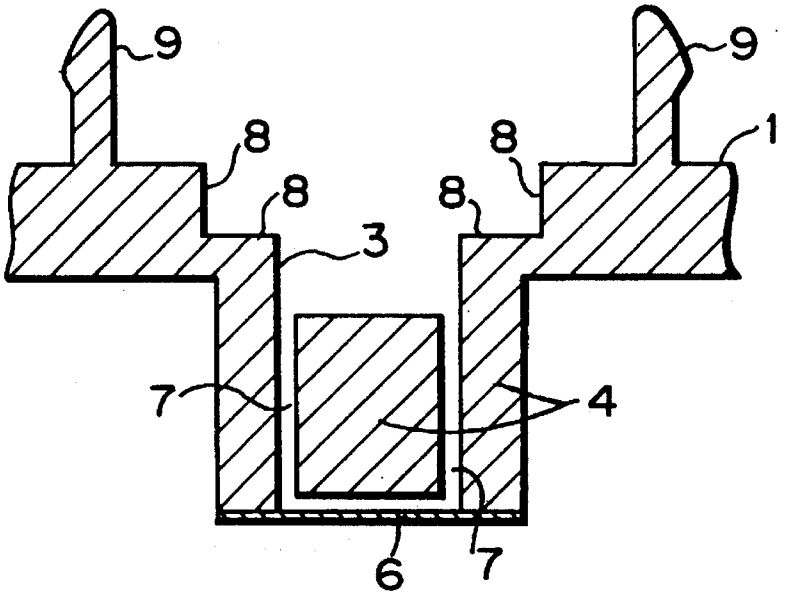
FIG. 2B is a cross section taken along the line B-B' of FIG. 2A.

FIGS. 2A and 2B show a second embodiment of an ink container according to the present invention, FIG. 2A being the front view and FIG. 2B being a cross section taken along the line B-B' of FIG. 2A. The difference between the first embodiment and the second embodiment is that while in the first embodiment the radius of an imaginary cylinder on which the fine holes 7 are arranged is set greater than the radius of the opening 3, the second embodiment has set almost equal the radii of the opening 3 and of an imaginary cylinder on which the fine holes 7 are arranged. That is, in this embodiment the fine holes 7 are arranged along and in contact with the extension of the inner circumferential surface of the opening 3. The ink container of the second embodiment, like the first one, allows ink in and around the opening 3 to be drawn back into the ink container under negative pressure through the fine holes 7.

(Embodiment 3)

Figure 3A:
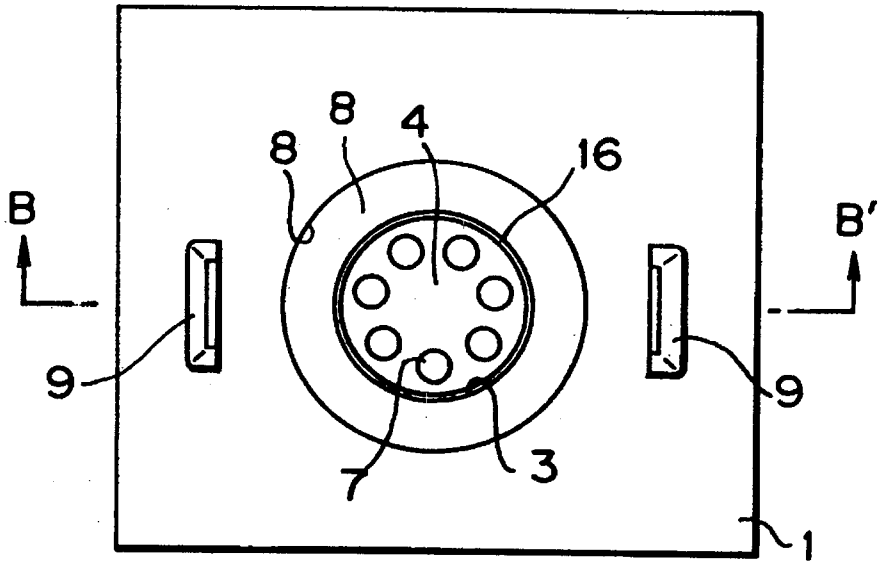
FIG. 3A is a front view of a third embodiment of an ink container according to the present invention.
Figure 3B:
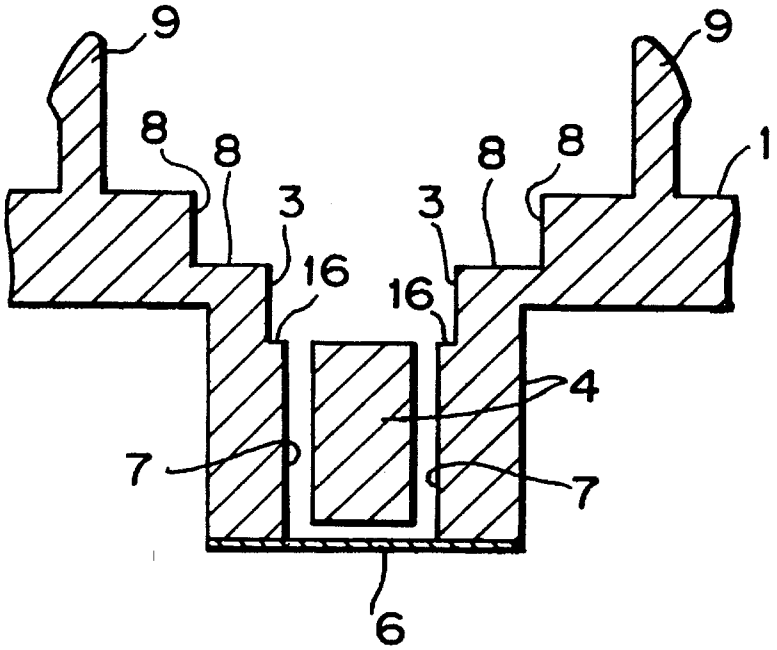
FIG. 3B is a cross section taken along the line B-B' of FIG. 3A.

FIGS. 3A and 3B show a third embodiment of an ink container according to the present invention, FIG. 3A being a front view and FIG. 3B being a cross section taken along the line B-B'. This embodiment is characterized in that the fine holes are not arranged in contact with the continuous extension of the inner circumferential surface of the opening 3 and that the inner circumferential surface of the opening 3 is formed with a step 16 concentric with the step 8. The upper surface of the step 16 is flush with the top surface of the solid portion 4 and has a width of less than 1 mm. Even when ink adhering to the inner circumferential surface of the opening 3 cannot be directly drawn into the ink container through the fine holes 7 because the fine holes 7 are not in contact with the continuous extension of the inner circumferential surface of the opening 3, it is possible to draw the ink back into the ink container by letting the ink move along the step 16.

(Embodiment 4)

Figure 4A:
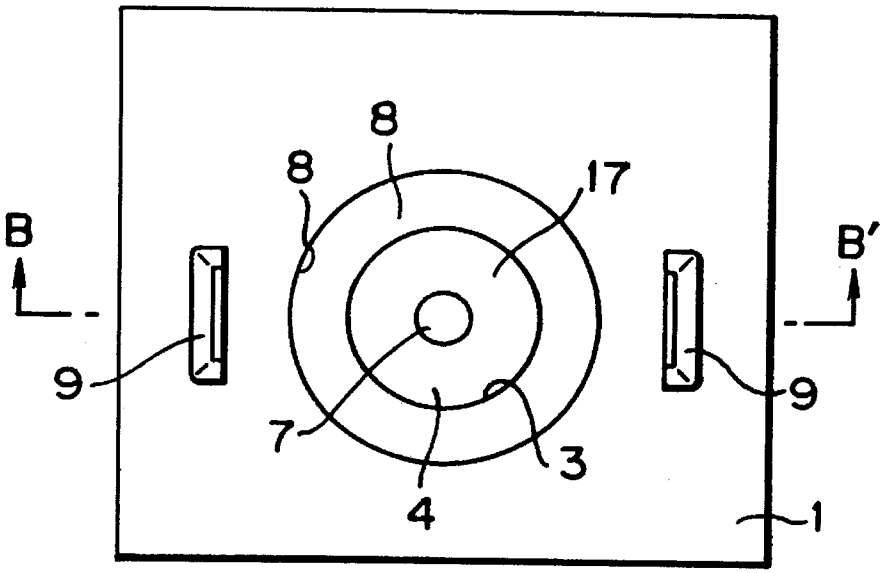
FIG. 4A is a front view of a fourth embodiment of an ink container according to the present invention.
Figure 4B:
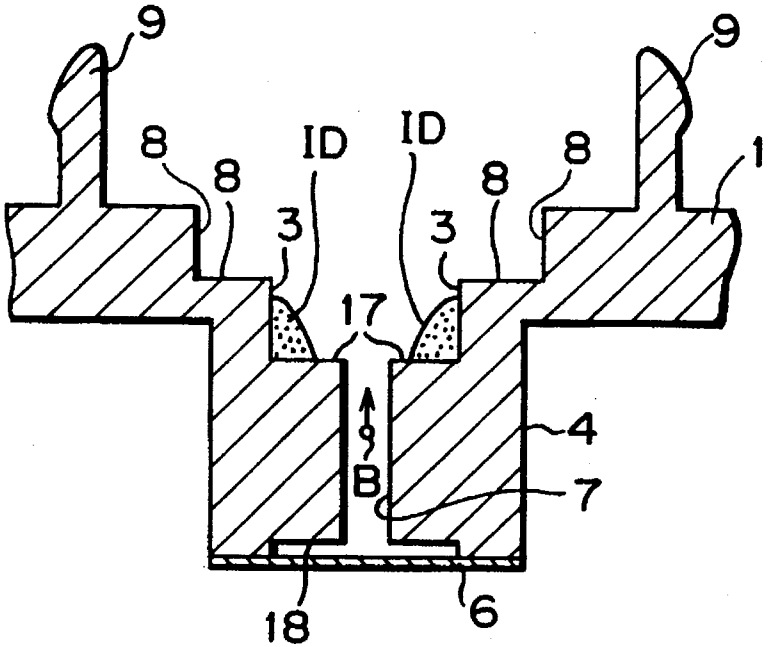
FIG. 4B is a cross section taken along the line B-B' of FIG. 4A.

FIGS. 4A and 4B show a fourth embodiment of an ink container according to the present invention, FIG. 4A being a front view and FIG. 4B being a cross section taken along the line B-B' of FIG. 4A. This embodiment is characterized in that the inner circumferential surface of the opening 3 is formed with a step 17 concentric with the step 8, that a single fine hole 7 is formed through the axis of the solid portion 4, and that the projected end of the solid portion 4 is formed with a recess 18 that communicates to the fine hole 7 and which forms a clearance from the cartridge filter 6. The width of the step 17 is larger than the width of the step 16 of the third embodiment and is almost equal to the radius of the solid portion 4 minus the radius of the single fine hole 7. Ink droplets ID adhering to the upper surface of the step 17 move along the inner surface of the center fine hole 7 returning to the recess 18 and the filter 6. The recess 18 serves as a means to remove air bubbles, that is, temporarily retains air bubbles present in the ink that has passed through the filter or in the ink that has returned along the fine hole 7 to the recess 18. The recess 18 is formed by cutting and removing a circular portion at the center of the projected end surface of the solid portion 4. The air bubbles B retained in this recess 18 are forced out through the recording head during the ink ejection performance recovering operation.

(Embodiment 5)

Figure 5A:
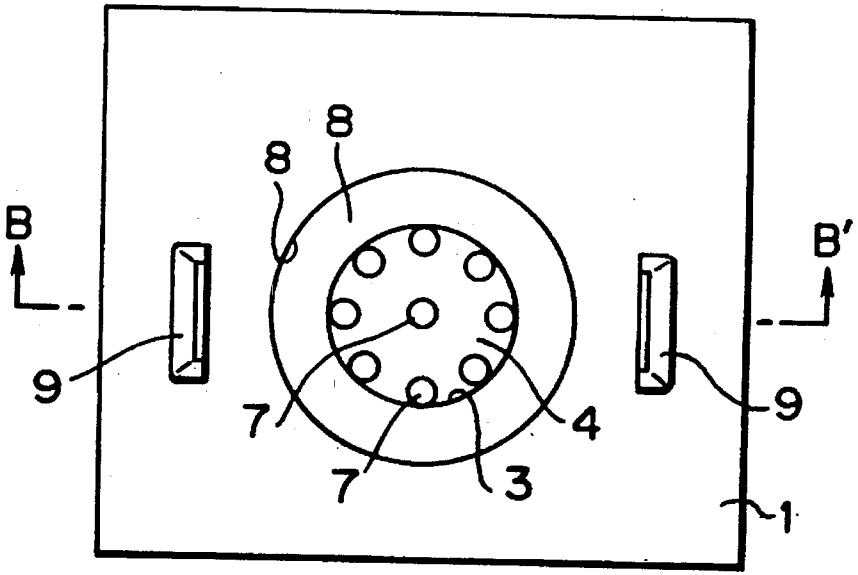
FIG. 5A is a front view of a fifth embodiment of an ink container according to the present invention.
Figure 5B:
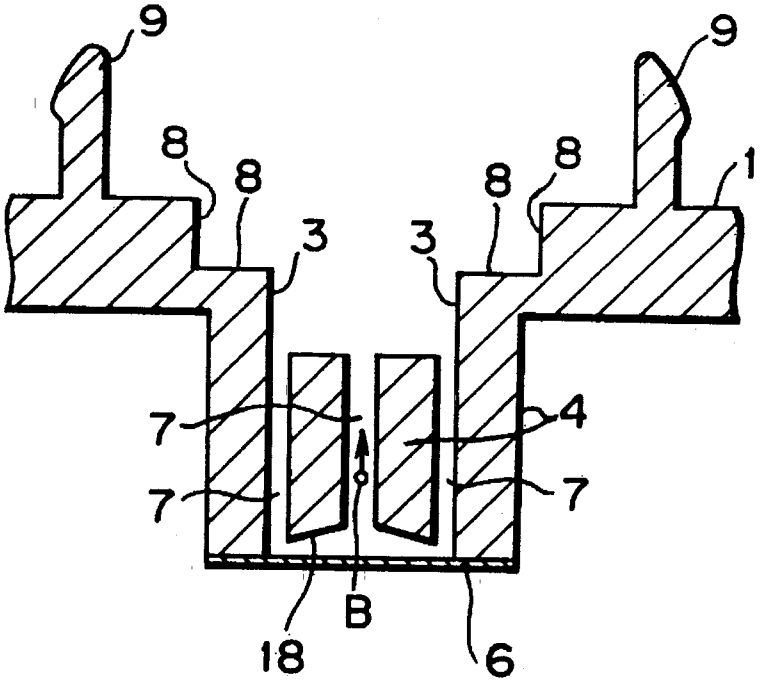
FIG. 5B is a cross section taken along the line B-B' of FIG. 5A.

FIGS. 5A and 5B show a fifth embodiment of an ink container of the present invention, FIG. 5A being a front view and FIG. 5B being a cross section taken along the line B-B' of FIG. 5A. This embodiment is characterized in that the solid portion 4 has one fine hole 7 formed along the axis thereof and also a plurality of fine holes 7 formed along the extension of the inner circumferential surface of the opening 3 at equal intervals with the one fine hole 7 at the axis as the center of the ring of the surrounding fine holes 7 and that a recess 18 has a shape different from the recess 18 of the fourth embodiment. The recess 18 of this embodiment is shaped like a funnel cutting into the entire projected end surface of the solid portion 4, with the bottom of the recess 18*a* portion farthest from the cartridge filter 6 communicating with the center fine hole 7 at the axis of the solid portion 4. In this embodiment also, the air bubbles B remaining in the recess 18 can be forced out into the opening 3 efficiently.

(Embodiment 6)

Figure 6:
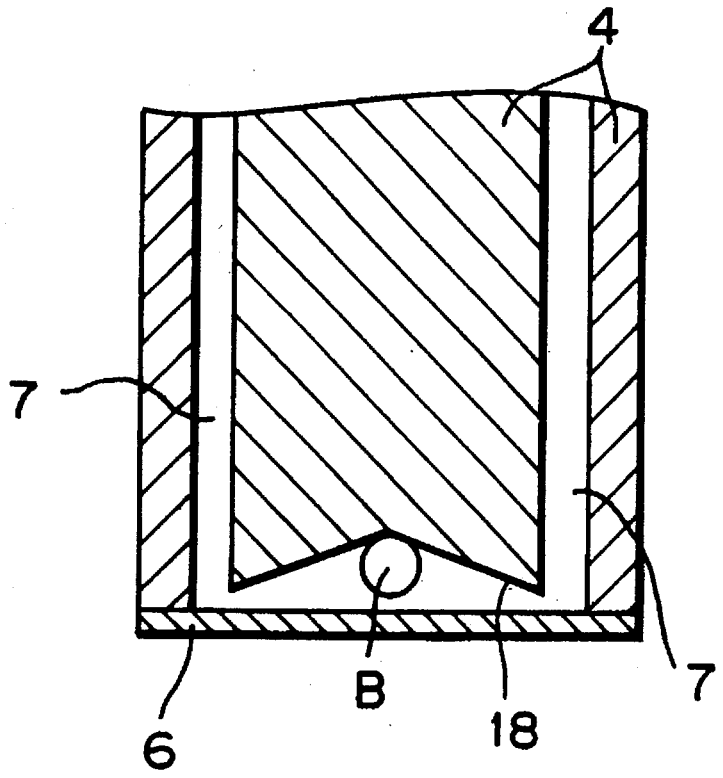
FIG. 6 is an enlarged cross-sectional view showing an essential portion of a sixth embodiment of the ink container according to the present invention.

FIG. 6 is an enlarged cross-sectional view showing an essential portion of an ink container as a sixth embodiment of the present invention. This embodiment is characterized in that the center fine hole 7 running along the axis of the solid portion 4 is not provided as was in the fifth embodiment. This embodiment has the advantage of being capable to preventing the air bubbles B remaining in the recess 18 from moving toward the opening 3.

(Embodiment 7)

Figure 7A:
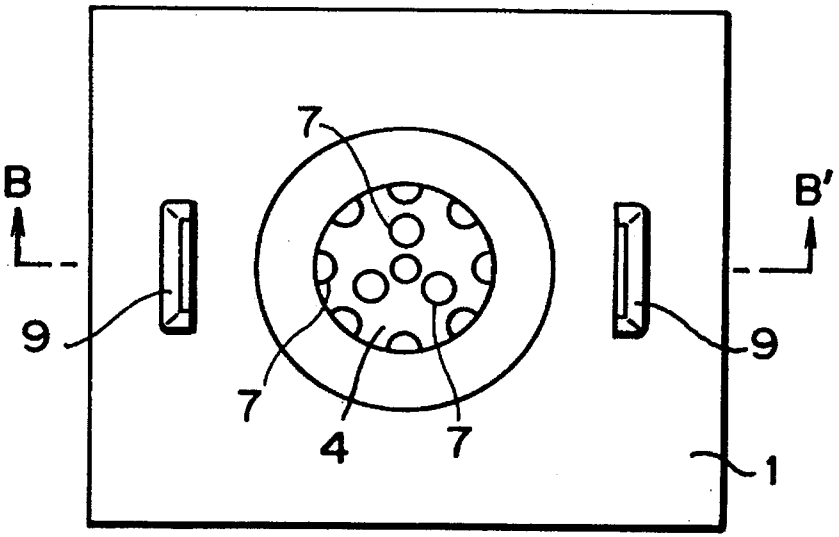
FIG. 7A is a front view of a seventh embodiment of an ink container according to the present invention.
Figure 7B:
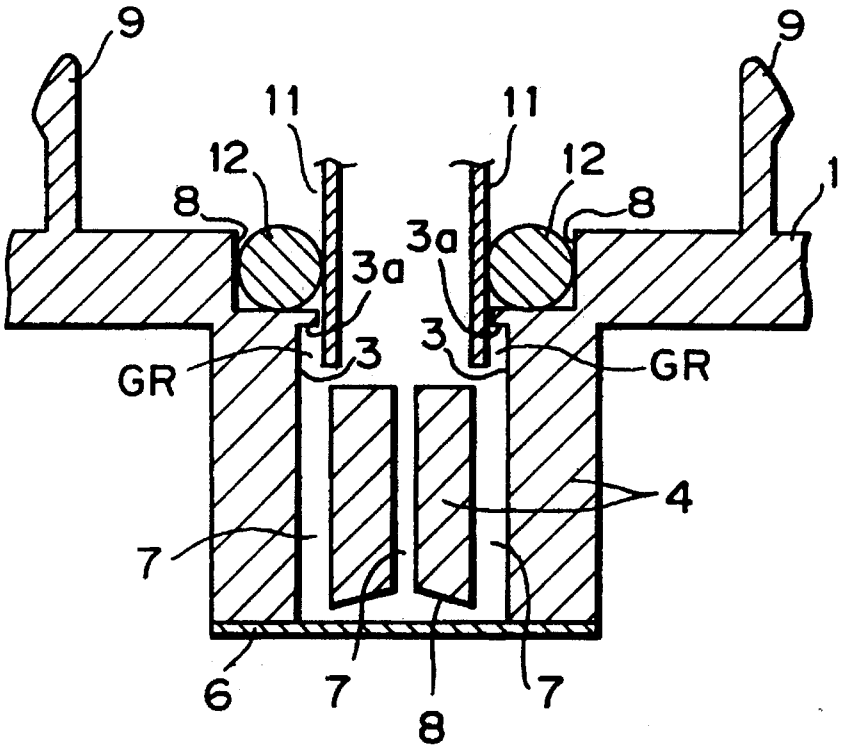
FIG. 7B is a fragmentary cross section taken along the line B-B' of FIG. 7A.

FIGS. 7A and 7B show a seventh embodiment of an ink container according to the present invention, FIG. 7A being a front view and FIG. 7B a fragmentary enlarged cross section taken along the line B-B' of FIG. 7A. This embodiment is characterized in that the opening 3 has a small-diameter portion 3*a* whose diameter is slightly reduced from that of the opening 3 and that a plurality of fine holes 7 arranged along the circumferential surface contiguous to the inner circumferential surface of the opening 3 have a cross section different from those of other embodiments, as shown in FIG. 7A. In this embodiment, as shown in FIG. 7B, when the ink container is mounted to the recording head to form a cartridge, the insertion pipe 11 of the recording head is inserted into the opening 3 of the ink container. At this time, the front end (lower end in FIG. 7B) of the insertion pipe 11 advances beyond the small-diameter portion 3*a* of the opening 3 and comes close to the solid portion 4 of the ink inductive portion, so that a groove GR is formed by the front end of the insertion pipe 11, the opening 3 and the small-diameter portion 3*a*. Because ink at and around the opening 3 is retained in the groove GR, it can be reliably prevented from leaking out or splashing even when the cartridge is subjected to impact as by fall. Further, when the ink container is not mounted to the recording head and is handled solely, it is likewise possible to prevent the ink splashing and also to draw the ink remaining at or around the opening 3 back into the ink container kept under negative pressure through the fine holes 7.

The embodiment 2 through embodiment 7 can be removably mounted to the recording head of a construction shown in FIG. 1C, as in the first embodiment. The ink jet cartridge consisting of the recording head and the ink container coupled to it can be mounted to the ink jet recording apparatus shown in FIG. 8.

Figure 8:
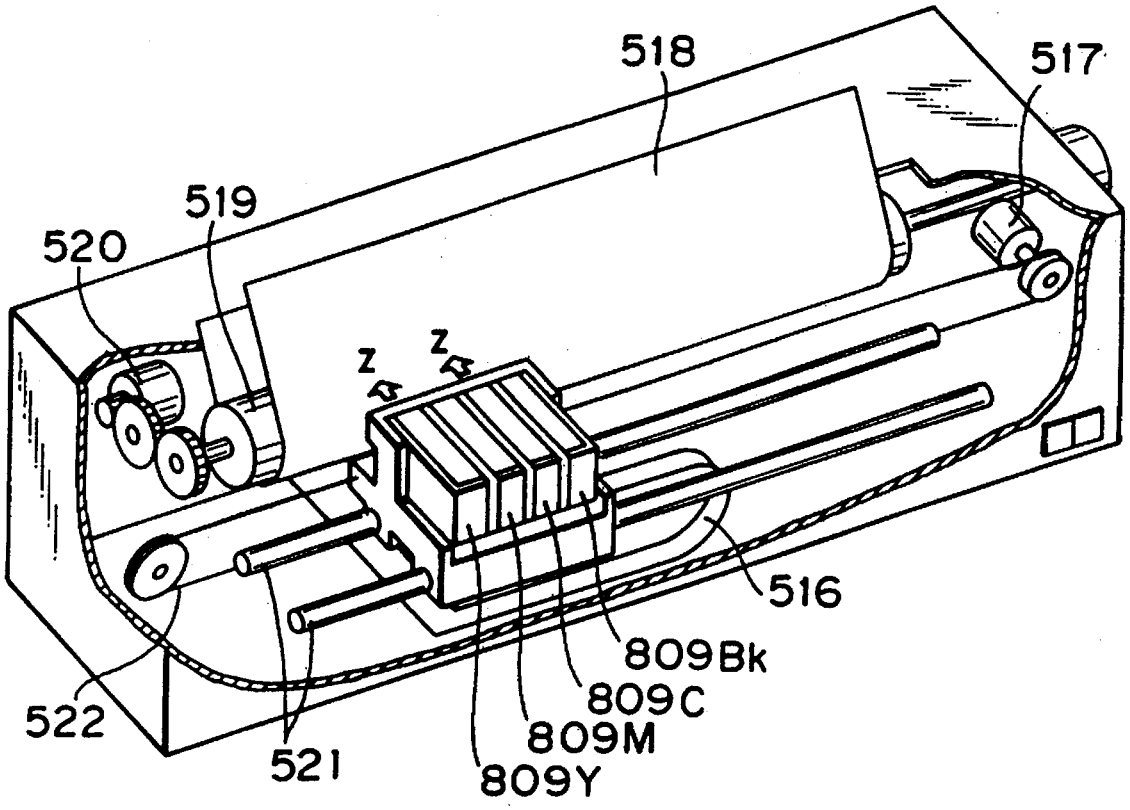
FIG. 8 is a schematic perspective view showing one embodiment of an ink jet recording apparatus according to the present invention.

FIG. 8 shows a partly cutaway schematic perspective view of one embodiment of an ink jet recording apparatus of the present invention.

In FIG. 8, designated 809Y, 809M, 809C and 809Bk are cartridges (they are generally denoted as a cartridge 809, with each component cartridge given an additional reference code "Y", "M", "C" and "Bk" at the end of the reference number). The cartridge 809 is fixedly mounted on a carriage 515, which can be reciprocally moved in a longitudinal direction along shafts 521. The positioning of the cartridge with respect to the carriage 515 may be done by a hole provided in the recording head and a dowel provided on the side of the carriage 515. Further, electric connection between them can be made by connecting a connector on the carriage 515 to a connection pad provided to a printed circuit board (not shown) for a nozzle section 602. Alternatively, a card edge connector contact may be formed at the connection pad.

Ink ejected from the nozzle 602A reaches a recording medium 518 whose recording surface is set a small distance from the recording head by a platen roller 519 to form an image on the recording medium 518.

An ink ejection signal that corresponds to image data is supplied to the recording head from a data source not shown via a cable 516 and terminals connected to it. Depending on the ink colors used, one or more cartridges 809 (four in FIG. 8) may be mounted.

In FIG. 8, reference numeral 517 represents a carriage motor that drives the carriage 515 along the shafts 521; and 522 represents a wire to transfer the driving force of the motor 517 to the carriage 515. Denoted 520 is a feed motor engaged with the platen roller 519 to feed the recording medium 518.

The nozzle 602A of the cartridge 809 may consist, for example, of 128 small nozzles arranged at 63.5 μm pitches.

The ink jet recording apparatus and the ink jet cartridge shown in FIG. 8 are only one example and any type of recording head can be used as long as it has a coupling means that permits connection and disconnection to and from the ink container of the present invention.

As explained above, since the ink container of this invention keeps the interior of the housing negative in pressure, the ink remaining around the opening of the ink supply means can be drawn through fine holes back into an ink holding means installed in the housing. Therefore, when the ink container is handled separatedly or subjected to impact as by fall, the ink can be prevented from spilling out of the opening. This makes the ink container highly reliable.

The present invention has been described in detail in connection with preferred embodiments. It is understood that various changes and modifications may be made to these embodiments without departing from the spirit of the invention and that those changes and modifications that fall within the true spirit of the invention are covered by the appended claims.

What is claimed is:

1. An ink container attachable to and detachable from a recording head, comprising:

a housing accommodating a means to hold ink; and an ink supply means provided in a part of the housing to supply ink held in the ink holding means to the recording head, wherein the ink supply means includes an opening penetrating through a wall portion of the housing and an ink inductive portion provided between the opening and the ink holding means, the ink inductive portion including a solid portion projecting from the wall portion of the housing near the opening toward the ink holding means, and at least one fine hole provided in the solid portion to always communicate the opening with the interior of the housings, and wherein ink is absent from within said fine hole at least when said ink container is separate from the recording head.

2. An ink container as claimed in claim 1, wherein the solid portion of the ink inductive portion is formed as a solid circular cylinder and the fine hole is a plurality of fine holes formed parallel to the axis of the solid portion and arranged at equal intervals along a circumferential surface of a cylinder which is concentric with and smaller in diameter than the cylindrical solid portion.

3. An ink container as claimed in claim 1, wherein the solid portion of the ink inductive portion is formed as a solid circular cylinder and the fine hole is formed at the axis of the solid portion.

4. An ink container as claimed in claim 1, wherein an inner surface of the opening and a part of an inner surface of the fine hole in the ink inductive portion are continuous with each other.

5. An ink container as claimed in claim 1, further comprising a connecting surface that makes continuous the inner surface of the opening and a part of the inner surface of the fine hole in the ink inductive portion.

6. An ink container as claimed in claim 1, wherein the ink holding means is a porous material and an end of the solid portion of the ink inductive portion presses against a part of the ink holding means.

7. An ink container as claimed in claim 6, further comprising a bubble removing means which includes a clearance defined between the end of the solid portion of the ink supply means and the ink holding means and which removes air bubbles from ink being supplied to the ink jet recording head by collecting and keeping the bubbles in the clearance.

8. An ink container as claimed in claim 7, wherein the bubble removing means is a recess formed in the end of the solid portion of the ink supply means.

9. An ink container as claimed in claim 8, wherein the bubble removing means cooperates with the fine hole formed at the axis of the solid portion of the ink supply means to discharge the bubbles removed from the ink and temporarily retained in the recess toward the opening side.

10. An ink container as claimed in claim 1, wherein the wall portion of the housing where the opening of the ink supply means is formed faces a wall portion of the housing where an air communicating hole is formed.

11. An ink container as claimed in claim 1, further comprising a first filter arranged at the end of the solid portion of the ink supply means to filter ink from the ink holding means.

12. An ink jet cartridge, comprising:

an ink container and an ink jet recording head which is attachable to and detachable from the ink container, wherein the ink container includes a housing having a means to hold ink;

an ink supply means provided in a part of the housing to supply ink held in the ink holding means to the ink jet recording head; and an engagement portion provided near the ink supply means to achieve coupling and decoupling between the housing and the ink jet recording head;

wherein the ink supply means includes an opening penetrating through a wall portion of the housing and an ink inductive portion provided between the opening and the ink holding means; and the ink inductive portion includes a solid portion that projects from the wall portion of the housing near the opening toward the ink holding means, and at least one fine hole provided in the solid portion to always communicate the opening with the interior of the housing, and wherein ink is absent from within said fine hole at least when said ink container is separate from the recording head; and wherein the ink jet recording head includes an engagement portion that engages with the engagement portion of the ink container;

a pipe to be inserted into the opening of the ink supply means of the ink container when the engagement portions of the ink container and the recording head are engaged;

an ink ejection port to eject ink supplied from the ink container through the pipe; and an ink ejection energy generating element to impart an energy to the ink ejected from the ink ejection port.

13. An ink jet cartridge as claimed in claim 12, further comprising a filter arranged between the pipe and the ink ejection port.

14. An ink jet cartridge as claimed in claim 12, wherein the ink ejection energy generating element is an electricity-heat converter that generates thermal energy to cause a surface boiling to the ink.

15. An ink jet recording apparatus, comprising:

an ink jet cartridge including an ink container and an ink jet recording head which is attachable to and detachable from the ink container; and a means to removably mount the ink jet cartridge to the ink jet recording apparatus;

wherein the ink container includes:

a housing having a means to hold ink;

an ink supply means provided in a part of the housing to supply ink held in the ink holding means to the ink jet recording head; and an engagement portion provided near the ink supply means to achieve coupling and decoupling between the housing and the ink jet recording head;

wherein the ink supply means includes an opening penetrating through a wall portion of the housing and an ink inductive portion provided between the opening and the ink holding means; and the ink inductive portion includes a solid portion that projects from the wall portion of the housing near the opening toward the ink holding means, and at least one fine hole provided in the solid portion to always communicate the opening with the interior of the housing, and wherein ink is absent from within said fine hole at least when said ink container is separate from said recording head; and wherein the ink jet recording head includes: an engagement portion that engages with the engagement portion of the ink container;

a pipe to be inserted into the opening of the ink supply means of the ink container when the engagement portions of the ink container and the recording head are engaged;

an ink ejection port to eject ink supplied from the ink container through the pipe; and an ink ejection energy generating element to impart an energy to the ink ejected from the ink ejection port.

16. An ink jet recording apparatus as claimed in claim 15, wherein the ink ejection energy generating element is an electricity-heat converter that generates thermal energy to cause a surface boiling to the ink.

* * * * *

UNITED STATES PATENT AND TRADEMARK OFFICE

CERTIFICATE OF CORRECTION

PATENT NO. : 5,604,523

DATED : February 18, 1997

INVENTOR(S) : KEIICHIRO TSUKUDA ET AL.

It is certified that error appears in the above-identified patent and that said Letters Patent is hereby corrected as shown below:

On the title page, item

AT [56] REFERENCES CITED

Foreign Patent Documents,
"2039945" should read --2-039945--.

COLUMN 1

Line 17, "Laid Open" should read --Laid-Open--.
Line 19, "hereinafter" should read --(hereinafter--.
Line 40, "These" should read --This--.
Line 42, "Laid Open" should read --Laid-Open--.
Line 56, "being occurred" should read --occurring--.

COLUMN 2

Line 6, "fall" should read --fall,--.

COLUMN 4

Line 60, "ducing" should read --inducing--.

COLUMN 5

Line 11, "amounting" should read --mounting--.
Line 35, "are" should read --is--.
Line 54, "0-ring 12" should read --O-ring 12--.
Line 64, "an enough" should read --a sufficient--.

COLUMN 6

Line 22, "numerical 10" should read --numeral 10--.
Line 28, "0-ring 12" should read --O-ring 12--.

UNITED STATES PATENT AND TRADEMARK OFFICE

CERTIFICATE OF CORRECTION

PATENT NO. : 5,604,523

DATED : February 18, 1997

INVENTOR(S) : KEIICHIRO TSUKUDA ET AL.

It is certified that error appears in the above-identified patent and that said Letters Patent is hereby corrected as shown below:

COLUMN 8

Line 12, "to" should read --of--.
Line 60, "515," should be deleted.
Line 62, "515" should be deleted.
Line 64, "carriage 515." should read --carriage.--.
Line 66, "515" should be deleted.
Line 67, "section 602." should read --section.--.

COLUMN 9

Line 3, "the nozzle 602A" should read --a nozzle--.
Line 13, "515" should be deleted.
Line 15, "Denoted" should read --Denoted by--.
Line 15, "carriage 515." should read --carriage.--.
Line 18, "602A" should be deleted.
Line 56, "housings," should read --housing,--.

COLUMN 10

Line 39, "includes" should read --includes:--.
Line 59, "includes" should read --includes:--.

COLUMN 11

Line 11, "including" should read --including:--.
Line 12, "container and" should read --container; and--.

UNITED STATES PATENT AND TRADEMARK OFFICE

CERTIFICATE OF CORRECTION

PATENT NO. : 5,604,523

DATED : February 18, 1997

INVENTOR(S) : KEIICHIRO TSUKUDA ET AL. Page 3 of 3

It is certified that error appears in the above-identified patent and that said Letters Patent is hereby corrected as shown below:

COLUMN 12

Line 11, "an" should read --¶ an--.

Signed and Sealed this

Sixteenth Day of September, 1997

Bruce Lehman

*Attest:*

BRUCE LEHMAN

*Attesting Officer*

*Commissioner of Patents and Trademarks*